United States Patent [19]

Heitmann

[11] Patent Number: 5,072,741

[45] Date of Patent: Dec. 17, 1991

[54] METHOD OF AND APPARATUS FOR SIMULTANEOUSLY MAKING PLURAL TOBACCO FILLER STREAMS

[75] Inventor: Uwe Heitmann, Hamburg, Fed. Rep. of Germany

[73] Assignee: Körber AG, Hamburg, Fed. Rep. of Germany

[21] Appl. No.: 641,545

[22] Filed: Jan. 15, 1991

[30] Foreign Application Priority Data

Jan. 18, 1990 [DE] Fed. Rep. of Germany ..... 4001285

[51] Int. Cl.[5] ..... A24C 5/18

[52] U.S. Cl. ..... 131/84.1; 131/84.3; 131/110

[58] Field of Search ..... 131/281, 84.1–84.3, 131/84.4, 110

[56] References Cited

U.S. PATENT DOCUMENTS 3,779,252 12/1973 Brackmann et al. ..... 131/110 X
4,185,644 1/1980 Heitmann ..... 131/109 R
4,564,027 1/1986 Heitmann ..... 131/84.3
4,848,369 7/1989 Siems ..... 131/84.4
4,889,138 12/1989 Heitmann ..... 131/84.1

*Primary Examiner*—V. Millin
*Assistant Examiner*—J. L. Doyle
*Attorney, Agent, or Firm*—Peter K. Kontler

[57] ABSTRACT

A relatively wide first layer of tobacco particles is broken up into several narrower second and several narrower third layers. The second layers are converted into a first tobacco filler stream which is trimmed to form a rod-like filler ready to be draped into a web of cigarette paper, and the third layers are converted into a second tobacco filler stream which is ready to be trimmed to form a rod-like filler ready to be draped into a web of cigarette paper. The tobacco layers are caused to advance along and closely follow concave sides of guide surfaces and are propelled along the respective surfaces by streams of compressed air. Subdivision of the first layer into several second and several third layers reduces the likelihood of unmixing or dehomogenization of the mixtures of tobacco particles which are about to be converted into plural tobacco filler streams.

21 Claims, 3 Drawing Sheets

METHOD OF AND APPARATUS FOR SIMULTANEOUSLY MAKING PLURAL TOBACCO FILLER STREAMS

BACKGROUND OF THE INVENTION

The invention relates to the making of tobacco streams (hereinafter called tobacco filler streams or filler streams) which are to be transformed into rod-like fillers for the production of cigarettes, cigarillos, cigars, cheroots and analogous rod-shaped smokers' products. More particularly, the invention relates to improvements in methods of and in apparatus for simultaneously making a plurality of tobacco filler streams.

It is already known to simultaneously produce two tobacco filler streams by dividing a single layer of tobacco particles into two narrower layers each of which is converted into a discrete filler stream. As a rule, the single layer is advanced along a concave path in a direction from a station where particles of tobacco are gathered into the single layer toward two endless foraminous belt conveyors each of which accepts one of the narrower layers and converts it into a filler stream. The filler streams are then ready to be transformed into rod-like fillers, normally by removing therefrom surpluses of tobacco particles. The fillers are thereupon draped into webs of cigarette paper or other suitable wrapping material to form with the draped webs continuous rods which are ready to be subdivided into rod-shaped smokers' products of unit length or multiple unit length.

The belt conveyors normally advance the respective filler streams at right angles to the direction of advancement of narrower layers toward the converting stations. Reference may be had, for example, to commonly owned U.S. Pat. No. 4,889,138 describing an apparatus wherein a single concave surface for the single tobacco layer is followed by two narrower surfaces each of which receives and guides one of the two narrower layers toward the respective foraminous belt conveyor. A drawback of the apparatus which is described in U.S. Pat. No. 4,889,138 is that it must be equipped with rather complex, expensive and bulky means for ensuring that the quality of one of the two tobacco filler streams will match or at least closely approximate the quality of the other filler stream. The most important criteria of tobacco filler streams are the weight of each unit length of filler stream, the density, the hardness and particularly the homogeneousness, i.e., the extent to which various types of tobacco particles are intermixed in successive increments of each filler stream. Each filler stream normally contains several types or brands of tobacco, such as Virginia, Burley and Oriental, short and long shreds, particles of tobacco leaf laminate and fragments of tobacco ribs and/or particles of natural tobacco, reconstituted tobacco and substitute tobacco. It is desirable to ensure that each and every unit length of each of a plurality of simultaneously produced filler streams will contain identical quantities of all ingredients or constituents because even minor departures from homogeneousness of the mixture can greatly affect the taste and/or other desirable characteristics of rod-shaped smokers' products.

OBJECTS OF THE INVENTION

An object of the invention is to provide a novel and improved method of simultaneously making a plurality of tobacco filler streams in such a way that the simultaneously produced streams exhibit identical or practically identical characteristics, especially as concerns their homogeneousness.

Another object of the invention is to provide a method which renders it possible to regulate the quantity of tobacco particles in simultaneously produced tobacco filler streams.

A further object of the invention is to provide a method which can be practiced to simultaneously produce several tobacco filler streams having two or more identical characteristics, such as density, homogeneousness, weight and hardness.

An additional object of the invention is to provide a method which can be practiced by resorting to apparatus which constitute simple modifications of conventional apparatus.

Still another object of the invention is to provide a method which renders it possible to enhance the homogeneousness of a plurality of simultaneously produced tobacco filler streams without increasing the dimensions of the apparatus for the practice of the method.

A further object of the invention is to provide an apparatus for the practice of the above outlined method and to construct and assemble the apparatus in such a way that the homogeneousness of simultaneously produced plural tobacco filler streams is more satisfactory than the homogeneousness of filler streams which are produced in conventional apparatus.

Another object of the invention is to provide the above outlined apparatus with novel and improved means for breaking up a single layer of tobacco particles into narrower layers.

An additional object of the invention is to provide a tobacco rod making machine which embodies the above outlined apparatus.

A further object of the invention is to provide the apparatus with novel and improved means for controlling the transport of tobacco particles between a distributor or hopper and the stations where the particles are converted into plural tobacco filler streams.

Still another object of the invention is to provide the apparatus with novel and improved means for regulating the ratio of tobacco particles in simultaneously produced plural tobacco filler streams.

A further object of the invention is to provide a novel and improved method of and a novel and improved apparatus for simultaneously making a plurality of tobacco filler streams of superior quality as concerns the homogeneousness of their constituents, their weight, their density, their hardness and/or their color.

SUMMARY OF THE INVENTION

One feature of the present invention resides in the provision of a method of simultaneously producing a plurality of tobacco filler streams which can be transformed (normally by trimming or equalizing, i.e., by removal of surplus particles) into the fillers of cigarette rods or rods for the making of other types of rod-shaped smokers' products. The improved method comprises the steps of gathering particles of natural, reconstituted and/or substitute tobacco into a first layer having a first width and advancing the layer in a predetermined direction along a predetermined path which is defined by a substantially concave first surface, maintaining the first layer in close proximity of the first surface during advancement in the predetermined direction, breaking up the first layer into a plurality of second layers having a second width and into a plurality of third layers having a third width (which may but need not equal the second width) and alternating with the second layers, conveying at least the third layers along second surfaces which are offset relative to the first surface, converting the second layers into a first continuous filler stream, and converting the third layers into a second continuous filler stream.

The second layers can jointly contain substantially one-half of tobacco particles of the first layer, and the third layers can jointly contain the remaining tobacco particles of the first layer.

The conveying step can comprise moving the third layers substantially in the predetermined direction along a second path, and such method preferably further comprises the step of conveying the second layers substantially in the predetermined direction along a third path which gradually diverges from the second path, i.e., the orientation of the second path relative to the predetermined path for the first layer is different from the orientation of the third path.

The width of at least one of the second and third layers can deviate (depart) from the width of the other second and third layers. The arrangement may be such that the width of at least one second layer departs from the width of each other second layer and that the width of at least one third layer departs from the width of each other third layer.

The method can further comprise the step of varying the width of at least one of the second and third layers, e.g., to ensure that each of the two filler streams will contain the same quantity of tobacco particles. The at least one layer can constitute one of the third layers, namely one of those layers whose orientation with reference to the first layer is changed to a greater extent than the orientation of the other (second) layers.

Another feature of the present invention resides in the provision of an apparatus for simultaneously producing a plurality of tobacco filler streams for transformation (e.g., by trimming or equalizing) into the fillers of cigarette rods or the like. The improved apparatus comprises means (e.g., a standard hopper or distributor) for gathering particles of natural, reconstituted and/or substitute tobacco into a first layer having a first width. Such gathering means preferably includes a substantially concave first surface and means (e.g., in the form of one or more plenum chambers and nozzles which receive from the plenum chamber or chambers a compressed gas, such as air, to propel the particles of the first layer in a predetermined direction, preferably close to and along the first surface). The improved apparatus further comprises means for breaking up the first layer into a plurality of second layers having a second width and into a plurality of third layers having a third width (which may but need not equal the second width) and alternating with the second layers. The means for breaking up the first layer preferably includes a plurality of second surfaces for the second layers and a plurality of third surfaces for the third layers, and the orientation of the second surfaces relative to the first surface departs from orientation of the third surfaces relative to the first surface. Still further, the improved apparatus comprises means for converting all of the second layers into a first continuous filler stream, and means for converting all of the third layers into a second continuous filler stream.

Each converting means can comprise a pneumatic conveyor having means (e.g., in the form of an endless foraminous belt) for moving the respective filler stream in a second direction substantially transversely of the predetermined direction.

The means for breaking up the first layer is preferably designed to form a plurality of second layers which jointly receive substantially one-half of tobacco particles in the first layer and a plurality of third layers which jointly contain the remaining particles of the first layer, i.e., each of the two filler streams can contain the same quantity of tobacco particles.

The second and third surfaces are or can be positioned to deliver the second and third layers at least close to the pneumatic conveyors of the respective converting means.

In accordance with a presently preferred embodiment, the second and third surfaces are at least partially concave surfaces (in the predetermined direction), and the means for breaking up the first layer can further comprise means (e.g., nozzles for compressed air) for advancing the second and third layers close to and along the second and third surfaces, respectively.

The orientation of the second surfaces can gradually depart from the orientation of the third surfaces in a direction from the first surface toward the respective converting means. For example, the concavity of the third surfaces can be more pronounced and the third surfaces can be shorter than the second surfaces.

The combined width of the second surfaces (as measured transversely of the predetermined direction) can depart from the combined width of the third surfaces. For example, at least one of the second surfaces can have a width which departs from the width of at least one other second surface, and at least one of the third surfaces can have a width which departs from the width of at least one other third surface.

The means for breaking up the first layer can further comprise means for varying the width of at least one of the second and third surfaces, i.e., the width of at least one of the second and third layers. The arrangement is preferably such that the at least one layer (of variable width) is one of the third layers.

Still further, the means for breaking up the first layer can comprise means for confining tobacco particles of the third layers to movement substantially exclusively along predetermined paths along the third surfaces from the first surface to the respective converting means. This can be achieved by employing third surfaces which are concave as seen transversely of the predetermined direction. Alternatively, or in addition to using such concave third surfaces, the confining means can comprise lateral barriers which flank the third surfaces to prevent tobacco particles from straying off the third surfaces and onto the adjacent second surface or surfaces. Still further, the width of the third surfaces transversely of the predetermined direction can increase from the first surface toward the respective converting means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
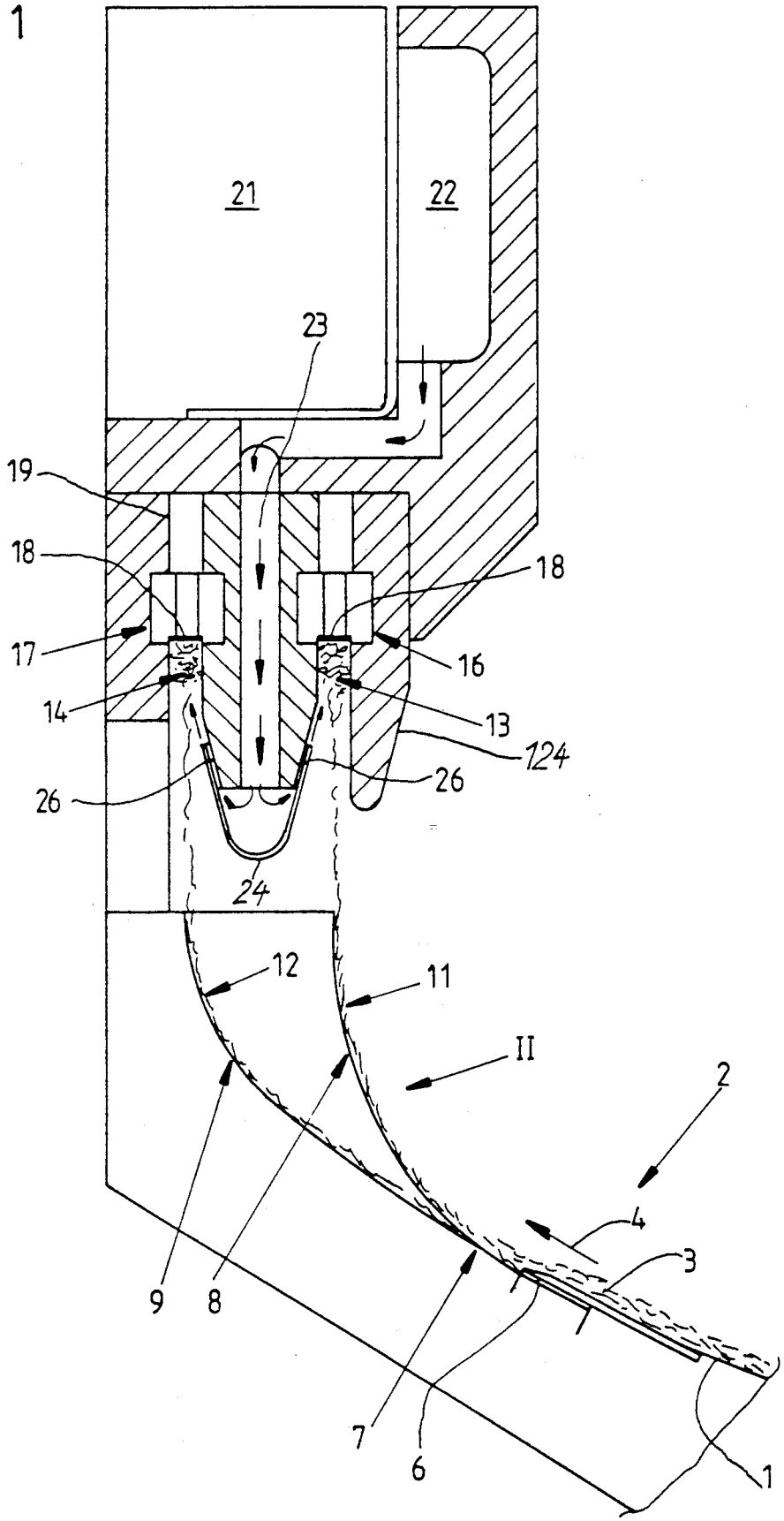
FIG. 1 is a fragmentary vertical sectional view of an apparatus which embodies one form of the invention and is designed to simultaneously produce two tobacco filler streams.

The apparatus which is shown in FIG. 1 constitutes a modification of the apparatus which is described and shown in U.S. Pat. No. 4,889,138. The improved apparatus comprises a distributor (also called hopper) which accumulates a relatively wide first layer 3 of tobacco particles on a gathering device 2 having means for advancing the layer 3 in the direction of arrow 4 along an upwardly sloping preferably concave first path which is defined by a surface 1. The advancing means comprises a plenum chamber and one or more nozzles 6 which discharge one or more streams or jets of compressed gaseous fluid (normally air) in the direction of arrow 4. The arrangement is preferably such that the first layer 3 closely follows the concave side of the surface 1 on its way toward a device which breaks up the layer 3 into a plurality of second layers 9 and a plurality of third layers 8. The layers 8, 9 alternate with each other and are narrower than the layer 3. The device which breaks up the first layer 3 has a set of (second) surfaces 12 for the second layers 9 and a set of third surfaces 11 for the layers 8. The orientation of the surfaces 11 relative to the surface 3 deviates from the orientation of the surfaces 12, and each of the second and third surfaces is at least partially concave at that side which is contacted by the respective (second and third) streams 8 and 9. The nozzle or nozzles 6 (and/or additional nozzles, not shown) ensure that the layers 9 closely follow the at least partially concave sides of the surfaces 12 and that the layers 8 closely follow the at least partially concave sides of the surfaces 11. The reference character 7 denotes the region where the surfaces 11 begin to deviate from the surface 1 and from the surfaces 12. The pressure of gaseous fluid which is discharged by the nozzle or nozzles 6 (and by additional nozzles, if any, adjacent the surfaces 11 and 12) determines the speed at which the layer 1 advances in the direction of arrow 4 and at which the layers 9 and 8 advance along the respective surfaces 12 and 11 toward two discrete stream forming or converting units 17 and 16, respectively. It will be seen that the narrower layers 8 and 9 also advance in the general direction (arrow 4) of propagation of the first layer 3 along the surface 1 of the gathering device 2.

All of the streams 9 are converted into a first tobacco filler stream 14 at the underside of the lower reach of an air-permeable endless belt conveyor 18 which forms part of the converting unit 17, and all of the layers 8 are converted into a second tobacco filler stream 13 at the underside of the lower reach of an endless air-permeable belt conveyor 18 forming part of the converting unit 16. The conveyors 18 advance the freshly formed tobacco filler streams 13 and 14 at right angles to the plane of FIG. 1 (note the arrow 224 in FIG. 5), i.e., substantially transversely of the direction (arrow 4) of advancement of layers 3, 8 and 9 toward the stream building stations.

The upper sides of lower reaches of the conveyors 18 are adjacent to channels 19 which convey air into a suction chamber 21. A plenum chamber 22 is adjacent the suction chamber 21 and admits compressed gaseous fluid (such as air) into a channel 23 which discharges compressed gaseous fluid against the concave side of a substantially U-shaped baffle 24 defining with the adjacent portion of a housing 124 two narrow passages 26 for the flow of compressed gaseous fluid toward the undersides of lower reaches of the belt conveyors 18. Such streams of gaseous fluid promote the conversion of successive increments of all layers 8 into successive increments of the filler stream 13 and the conversion of successive increments of all layers 9 into successive increments of the filler stream 14.

Figure 2:
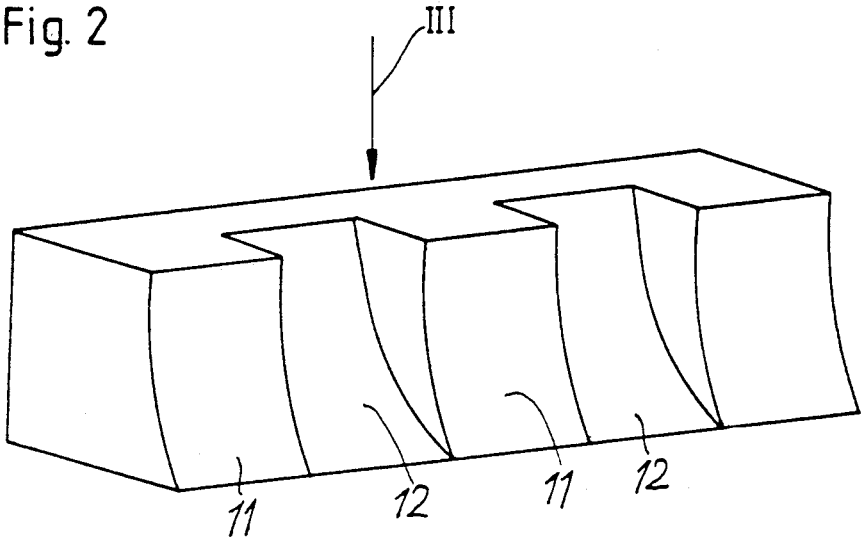
FIG. 2 is a perspective view of a portion of a device which can be used in the apparatus of FIG. 1 to break up the first layer into several second and several third layers, the view of FIG. 2 being taken in the direction of arrow II in FIG. 1.

FIG. 2 shows a portion of the breaking up device. The concave surfaces 11 which direct the layers 8 toward the converting unit 16 alternate with the concave surfaces 12 which direct the layers 9 toward the converting unit 17. The curvature of the surfaces 11 is more pronounced than the curvature of the surfaces 12. Some particles of tobacco which forms the layers 8 on the surfaces 11 are likely to slide laterally off the surfaces 11 and to gather on top of the adjacent layer or layers 9 to thus increase the quantity of tobacco in the filler stream 14. In order to prevent such unbalance between the quantities of tobacco particles in the filler streams 13 and 14, the unit which serves to break up the tobacco layer 3 into the layers 8 and 9 preferably further comprises means for confining tobacco particles in the layers 8 to movement along the respective surfaces 11, i.e., along predetermined paths which are defined by the respective surfaces 11.

Figure 3A:
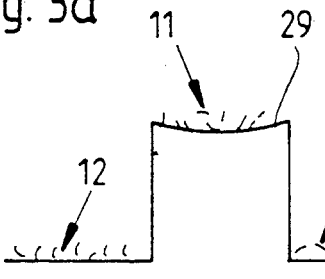
FIG. 3*a* is a fragmentary plan view of a portion of a breaking up device which is provided with first means for confining the advancement of tobacco particles in the second or third layers to predetermined paths, the view of FIG. 3*a* being taken in the direction of arrow III in FIG. 2.
Figure 3B:
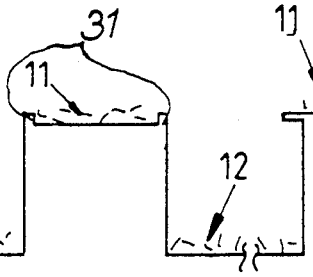
FIG. 3*b* is a similar plan view of modified confining means.
Figure 3C:
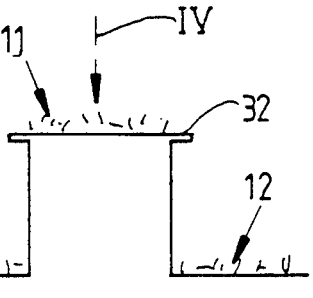
FIG. 3*c* is a similar plan view of third confining means.

The confining means can be designed in a number of different ways (three different types of confining means are shown in FIGS. 3*a*, 3*b* and 3*c*). Alternatively, or in addition to such confining means, the unit which breaks up the first layer 3 can be designed in such a way that the width of at least one of the surfaces 12 is less than the width of at least one of the surfaces 11 in order to compensate for the fact that some of the tobacco particles will slide off the surfaces 11 and will descend onto the adjacent layer or layers 9.

The confining means of FIG. 3*a* includes the surfaces 11 for the layers 8. These surfaces are concave transversely of the direction (arrow 4) of advancement of the layers 8 from the surface 1 toward the converting unit 16. Thus, tobacco particles forming the marginal portions 29 of the layers 8 are less likely to slide off the concave surfaces 11 and enter the layers 9 which are to be converted into the stream 14. Concave surfaces 11 of the type shown in FIG. 3*a* can be narrower than the adjacent surface or surfaces 12 in order to further reduce the likelihood of unequal distribution of tobacco particles of the first layer 3 between the tobacco filler streams 13 and 14.

FIG. 3*b* shows that the confining means can comprise lateral barriers 31 which flank the surfaces 11 in order to prevent tobacco particles from straying off the surfaces 11 and onto the adjacent layer or layers 9. The surface 11 which is shown in FIG. 3*b* can be concave, the same as the surface 11 of FIG. 3*a*, in order to further reduce the likelihood of lateral migration of tobacco particles off the surface 11 and onto the adjacent layer or layers 9.

Figure 4:
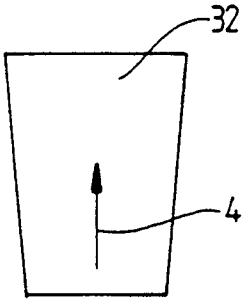
FIG. 4 is a plan view of a platform which is shown in FIG. 3*c*, as seen in the direction of arrow IV.

FIG. 3*c* shows that the confining means can comprise platforms 32 (one shown) which define the surfaces 11. The width of the platforms 32 increases in a direction from the station 7 toward the converting unit 16 (see FIG. 4 which is a plan view of a platform 32) at a rate which is necessary to account for the tendency of the layers 8 to expand laterally on their way from the layer 3 toward the tobacco filler stream 16.

Figure 5:
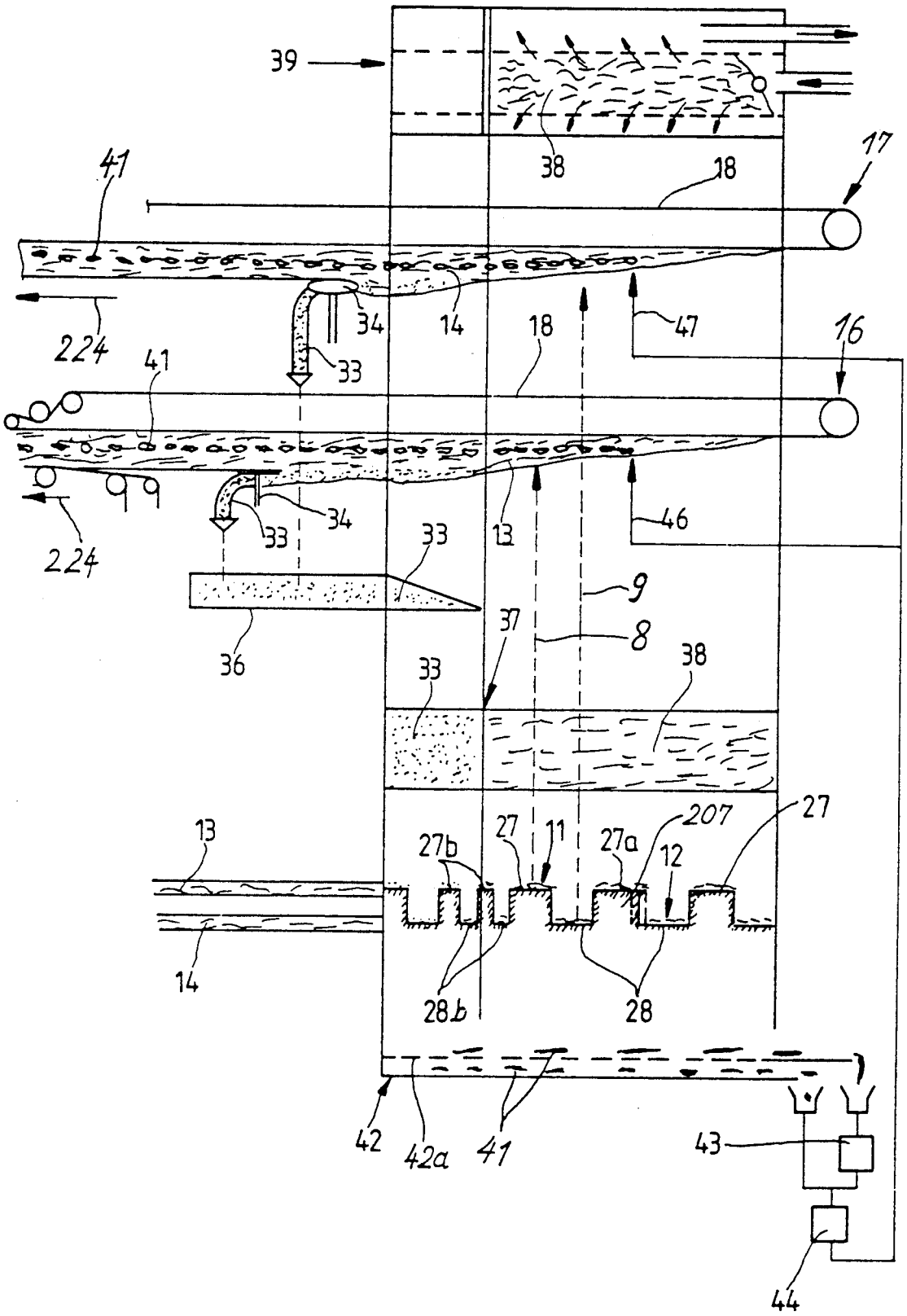
FIG. 5 is a fragmentary diagrammatic view of a rod making machine which embodies the improved apparatus.

The operators in charge or an automatic monitoring device can adjust the width of at least one of the surfaces 11 and/or 12 in order to compensate for imbalance between the quantities of tobacco particles in the streams 13 and 14. FIG. 5 shows, by way of example, that the effective width of one (27*a*) of the surfaces 11 can be varied between at least two values. The corresponding portion 207 of the breaking up device for the first layer 3 has two or more sections at least one of which can be shifted transversely of the direction which is indicated by arrow 4 to thereby vary the width of the respective surface 27*a* and, if desired, to simultaneously reduce the effective width of the adjacent surface 12. It is clear that the improved apparatus can be provided with means for varying the effective width of more than one surface 11 and/or for varying the effective width of one or more surfaces 12.

The effective width of one or more surfaces 11 and/or 12 can be varied by hand or by suitable (fluid-operated or other) motors in response to signals from means (not specifically shown) for monitoring the weight of rod-shaped smokers' products which are obtained from the filler streams 13 and 14. It is also possible to automatically adjust the effective width of one or more surfaces 11 and/or 12 in response to signals from trimming or equalizing devices 34 (FIG. 5) which are designed to remove the surplus 33 from the tobacco filler streams 13, 14 and to return the removed surplus 33 into the magazine 37 of the distributor or hopper via conveyor means 36. The returned surplus 33 normally contains at least some shorter tobacco shreds which should be thoroughly intermixed with the more desirable longer shreds. Such mixing is carried out in the magazine 37 or in another part of the distributor or hopper wherein the returned surplus is mixed with longer shreds 38. Such longer shreds are supplied at regular or irregular intervals by one or more gates 39 which form part of the means for supplying fresh tobacco particles into the magazine 37. The gate 39 which is shown in the upper portion of FIG. 5 receives a stream of tobacco shreds 38 from one or more pneumatic conveyors and is provided with several outlets (e.g., in the form of ports) for escape of pneumatic conveying fluid. Gates which can be utilized in conjunction with the distributor or hopper of FIG. 5 are described and shown, for example, in commonly owned copending U.S. patent application Ser. No. 431,473, now U.S. Pat. No. 5,009,238, granted Apr. 23, 1991 to which reference may be had if necessary.

In order to prevent the accumulation of returned surplus tobacco 33 in certain portions of the continuous tobacco filler stream 13 and/or 14 (e.g., in the event of unsatisfactory intermixing of the surplus 33 with the shreds 38 in the magazine 37), the breaking up device downstream of the surface 1 is preferably designed in such a way that one or more very narrow or relatively narrow surfaces 11 (shown at 27*b*) alternate with one or more very narrow or relatively narrow surfaces 12 (shown at 28*b*) to receive those portions of the layer 3 which are more likely or most likely to contain non-uniformly distributed returned surplus tobacco particles 33.

The distributor or hopper of FIG. 5 further comprises a sieve-like conveyor 42 which classifies fragments 41 of tobacco ribs during classification of tobacco particles advancing from the magazine 37 toward the gathering device 2. The larger fragments 41 are intercepted by a grate 42*a* of the conveyor 42 and are delivered into a mill 43 or another suitable comminuting device. The smaller fragments 41 bypass the mill 43 and are introduced into a pneumatic ejector 44 which also receives comminuted fragments from the mill 43. The fragments which leave the ejector 44 are fed into the building zone for the filler stream 13 (note the arrow 46) and into the building zone for the filler stream 14 (arrow 47) in such a way that the fragments of ribs are surrounded by shreds of tobacco leaf laminate. Reference may be had to commonly owned copending U.S. patent application Ser. No. 613201 filed Nov. 8, 1990 which fully describes, shows and claims the means for and the method of introducing fragments of tobacco ribs into selected portions of tobacco filler streams.

An important advantage of the improved method and apparatus is that the likelihood of dehomogenization of the mixture of various tobaccos which are conveyed from the magazine 37 toward the converting devices 16 and 17 is greatly reduced. In fact, additional homogenization is achieved as a result of breaking up the single first layer 3 into several second layers 9 and several third layers 8. The utilization of a breaking up device of the type shown in FIG. 5 (with second surfaces 12 including wider surfaces 28 and narrower surfaces 28*b*, and with third surfaces 11 including wider surfaces 27 and narrower surfaces 27*b*) also contributes to more intensive intermixing of different tobacco types (such as 33 and 38) to thus ensure that each of the tobacco filler streams 13 and 14 is homogeneous and can be converted into fillers of rod-shaped smokers' products having identical weights, densities and/or other desirable characteristics. The breaking up device with surfaces 27, 27*b* and 28, 28*b* can be omitted if the trimmed off surplus 33 is not returned into the distributor or hopper for readmission into the magazine 37.

One or more variable-width surfaces (note the surface 27*a* in FIG. 5) can be provided in addition to or in lieu of the aforedescribed tobacco confining means of FIGS. 3*a*, 3*b* and 3*c*. Such surfaces of variable width can be resorted to in order to ensure highly accurate distribution of tobacco particles of the layer 3 between the tobacco filler streams 13 and 14. The surface or surfaces of variable width are preferably those surfaces which guide one or more tobacco layers 8 toward the conveyor 18 of the converting unit 16 wherein the layers 8 are converted into the tobacco filler stream 13.

It has been found that the improved apparatus can deliver to the converting units 16 and 17 highly homogeneous layers of tobacco particles irrespective of whether or not the surplus 33 which has been removed at the unit 16 and/or 17 is returned into the magazine 37 of the distributor or hopper which supplies tobacco particles to the concave surface 1 for the gathering of tobacco particles into the first layer 3.

Certain details of a distributor or hopper which can be used to make the first layer 3 are disclosed in commonly owned U.S. Pat. No. 4,848,369 and in commonly owned copending U.S. patent application Ser. No. 530,920, filed May 30, 1990, to which reference may be had, if necessary. U.S. Pats. Nos. 4,185,644 and 4,564,027 also describe distributors or hoppers which can be used to form the layer 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of simultaneously producing a plurality of tobacco filler streams for transformation into the fillers of cigarette rods and the like, comprising the steps of gathering particles of tobacco into a first layer having a first width and advancing the layer in a predetermined direction along a predetermined path defined by a substantially concave first surface; maintaining the layer in close proximity of the first surface during advancement in said direction; breaking up the layer into a plurality of second layers having a second width and into a plurality of third layers having a third width and alternating with said second layers; conveying at least said third layers along second surfaces which are offset relative to said first surface; converting the second layers into a first continuous filler stream; and converting the third layers into a second continuous filler stream.

2. The method of claim 1, wherein the second layers jointly contain substantially one-half of tobacco particles of said first layer and the third layers jointly contain the remaining tobacco particles of said first layer.

3. The method of claim 1, wherein said conveying step comprises moving said third layers substantially in said direction along a second path and further comprising the step of conveying said second layers substantially in said direction along a third path which gradually diverges from said second path.

4. The method of claim 1, wherein the width of at least one of said second and third layers deviates from the width of the other second and third layers.

5. The method of claim 1, wherein the width of at least one of said second layers deviates from the width of each other second layer and the width of at least one of said third layers deviates from the width of each other third layer.

6. The method of claim 1, further comprising the step of varying the width of at least one of said second and third layers.

7. The method of claim 6, wherein said at least one layer is one of said third layers.

8. Apparatus for simultaneously producing a plurality of tobacco filler streams for transformation into the fillers of cigarette rods and the like, comprising means for gathering particles of tobacco into a first layer having a first width, including a substantially concave first surface and means for advancing said layer in a predetermined direction close to and along said first surface; means for breaking up said first layer into a plurality of second layers having a second width and into a plurality of third layers having a third width and alternating with said second layers, including a plurality of second surfaces for said second layers and a plurality of third surfaces for said third layers, the orientation of said second surfaces relative to said first surface being different from the orientation of said third surfaces; means for converting said second layers into a first continuous filler stream; and means for converting said third layers into a second continuous filler stream.

9. The apparatus of claim 8, wherein each of said converting means comprises a pneumatic conveyor having means for moving the respective filler stream in a second direction substantially transversely of said predetermined direction.

10. The apparatus of claim 8, wherein said means for breaking up said first layer is operative to form a plurality of second layers which jointly receive substantially one-half of tobacco particles in said first layer and a plurality of third layers which jointly contain the remaining particles of said first layer.

11. The apparatus of claim 8, wherein each of said converting means comprises a pneumatic conveyor and said second and third surfaces are positioned to deliver said second and third layers at least close to the respective pneumatic conveyors.

12. The apparatus of claim 8, wherein said second and third surfaces are at least partially concave surfaces and said means for breaking up said first layer further comprises means for advancing said second and third layers close to and along said second and third surfaces, respectively.

13. The apparatus of claim 8, wherein the orientation of said second surfaces gradually departs from the orientation of said third surfaces from said first surface toward the respective converting means.

14. The apparatus of claim 8, wherein said second surfaces have a combined width which departs from the combined width of said third surfaces.

15. The apparatus of claim 8, wherein at least one of said second surfaces has a width measured transversely of said direction which departs from the width of at least one other second surface and at least one of said third surfaces has a width which departs from the width of at least one other third surface.

16. The apparatus of claim 8, wherein said means for breaking up said first layer includes means for varying the width of at least one of said second and third layers.

17. The apparatus of claim 16, wherein said at least one layer is one of said third layers.

18. The apparatus of claim 8, wherein said means for breaking up said first layer comprises means for confining tobacco particles of the third layers to movement substantially exclusively along predetermined paths along said third surfaces from said first surface to the respective converting means.

19. The apparatus of claim 18, wherein said third surfaces are concave as seen transversely of said predetermined direction.

20. The apparatus of claim 18, wherein said confining means comprises lateral barriers flanking said third surfaces.

21. The apparatus of claim 18, wherein the width of said third surfaces transversely of said direction increases from said first surface toward the respective converting means.

* * * * *